United States Patent [19]

Davis et al.

[11] 4,382,799

[45] * May 10, 1983

[54] LOW TEMPERATURE BLEACHING WITH POSITIVE BROMINE IONS (BR+)

[75] Inventors: Thomas B. Davis, Cos Cob, Conn.; Theodore A. Girard, Williamsport, Pa.

[73] Assignee: Glyco Chemicals, Inc., Greenwich, Conn.

[ * ] Notice: The portion of the term of this patent subsequent to Nov. 25, 1997, has been disclaimed.

[21] Appl. No.: 310,904

[22] PCT Filed: Nov. 21, 1980

[86] PCT No.: PCT/US80/01563

§ 371 Date: Oct. 7, 1981

§ 102(e) Date: Oct. 7, 1981

[87] PCT Pub. No.: WO81/02314

PCT Pub. Date: Aug. 20, 1981

Related U.S. Application Data

[63] Continuation-in-part of PCT/US80/00133, Feb. 11, 1980, abandoned, which is a continuation-in-part of Ser. No. 911,190, May 30, 1978, Pat. No. 4,235,599.

[51] Int. Cl.[3] ..... D06L 3/06

[52] U.S. Cl. ..... 8/107; 8/108 R; 252/95; 252/99; 252/102; 252/187.2; 252/189.24; 252/187.25; 252/187.33; 252/187.34

[58] Field of Search ..... 8/107, 108 R; 252/95, 252/99, 102, 187 R, 187 H, 187 C

[56] References Cited

U.S. PATENT DOCUMENTS

| | | | |
|---|---|---|---|
| 2,184,888 | 12/1939 | Muskat et al. | 424/129 |
| 2,430,233 | 11/1947 | Magill | 252/187 R |
| 2,779,764 | 1/1957 | Paterson | 548/311 |
| 2,868,787 | 1/1959 | Paterson | 548/311 |
| 3,071,591 | 1/1963 | Paterson | 548/304 |
| 3,412,021 | 11/1968 | Paterson | 424/249 |
| 3,966,627 | 6/1976 | Gray | 252/95 |
| 4,235,599 | 11/1980 | Davis et al. | 8/108 R |

*Primary Examiner*—A. Lionel Clingman

*Attorney, Agent, or Firm*—Cushman, Darby & Cushman

[57] ABSTRACT

A method for the effective bleaching of textile goods at temperatures at or below about 140° F. which consists essentially in exposing same to an aqueous solution, at said temperatures, containing an amount effective for bleaching of a material capable of generating positive bromine ions (Br+) during the bleaching of said textile goods.

The material may be available from a wide variety of sources, including alkali metal hypobromites or alkali metal hypochlorites with a source of bromide ion or a material being selected from the group consisting of:

(a) an organo-N-bromo compound selected from the group consisting of N-brominated-hydantoins; N-brominated isocyanurates; N-brominated melamines and N-brominated glycolurils;

(b) an organo-N-chloro-N-bromo compound selected from the group consisting of N-chlorinated-N-brominated-5,5-dialkylhydantoins; N-chlorinated-N-brominated isocyanurates; N-chlorinated-N-brominated melamines and N-chlorinated-N-brominated glycolurils; and (c) an organo-N-chloro compound selected from the group consisting of N-chlorinated-5,5-dialkylhydantoins; N-chlorinated isocyanurates, N-chlorinated melamines and N-chlorinated glycolurils, in combination with an alkali metal or alkaline earth metal bromide salt, said alkyl containing up to 8 carbons.

40 Claims, 4 Drawing Figures

LOW TEMPERATURE BLEACHING WITH POSITIVE BROMINE IONS (BR+)

BACKGROUND OF THE INVENTION

Figure 1:
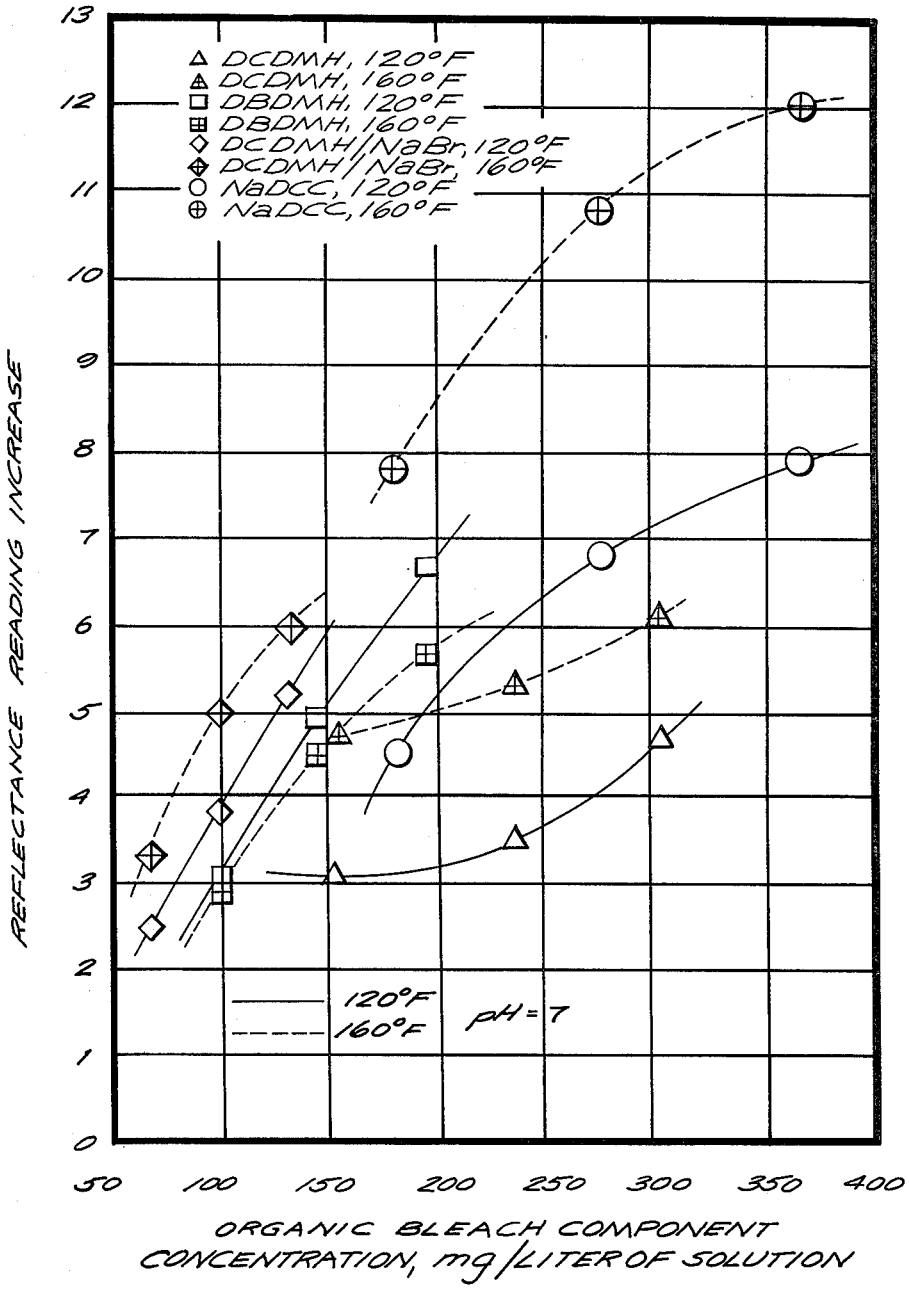

This application is a continuation-in-part of co-pending application Ser. No. PCT/US/80/00133 filed Feb. 11, 1980 which in turn is a continuation-in-part of application Ser. No. 911,190, filed May 30, 1978 now U.S. Pat. No. 4,235,599.

This invention relates to an improved bleaching agent composition for use in low temperature aqueous systems, e.g., temperatures of 140° F. or less and particularly about 120° F. or less, such as in laundry operations or in the commercial processing of textile materials, e.g., cotton grey goods, cotton/polyester blends and like goods.

The use of halogen-releasing agents for bleaching as well as disinfecting purposes in the processing or laundering of textile materials is, of course, well known, and has a long history. Various inorganic halogen-based bleaching agents are known including not only elemental chlorine gas, but also sodium hypochlorite, etc. In addition, a number of halogen-releasing organic agents have been disclosed as bleaching agents. These include, for instance, halogenated glycourils described in U.S. Pat. No. 3,071,591 and a number of other N-halogenated derivatives of amines, amides, imides, and various N-heterocyclic compounds, such as those mentioned in U.S. Pat. No. 3,412,021.

Characteristically, in previous years, bleaching agents for use in the laundering or processing of textile materials were employed in practice at relatively elevated temperatures of, for instance, about 160° F. (approx. 70° C.). For some years, however, there has been an interest in the processing of textiles in a bleaching environment at lower temperatures—dictated in part from the standpoint of energy conservation measures, and in part from the standpoint of protecting the textile material against chemical damage. At such lower temperatures, however, many of the most commonly used and hitherto satisfactory bleaching agents exhibit a substantially lower amount of activity, and hence are not useful at these temperatures activity.

There has consequently existed for some time a need for improved bleaching agents which can be effectively used at the desired lower processing temperatures. It is a principal object of this invention to provide such improved bleaching compositions, and which also offers a decrease in the amount of organic bleaching additive required for the purpose (thereby decreasing effluent contaminant problems), and with cost saving advantages.

SUMMARY OF THE INVENTION

The present invention is predicated on the discovery that effective bleaching of textile goods (especially cotton and blends thereof, e.g. cotton/polyester blends) can be accomplished at relatively low temperatures (e.g. below 140° F., and especially below 120° F.) when the goods are exposed to an aqueous solution which contains an amount effective for bleaching of a material capable of generating positive bromine ($Br^{30}$) ions during bleaching.

A wide variety of materials may be utilized to provide a source of positive bromine ions ($Br^{30}$) including akali metal hypochlorites in combination with a source of bromine (e.g. an alkali metal bromide or an organo-N-bromo compound).

According to one embodiment of the present invention, one may carry out effective low temperature bleaching utilizing a material selected from the group consisting of (a) an organo-N-bromo compound selected from the group consisting of N-brominated hydantoins; N-brominated isocyanurates; N-brominated melamines; N-brominated glycolurils and mixtures thereof;

(b) an organo-N-chloro-N-bromo compound selected from the group consisting of N-chlorinated-N-brominated hydantoins; N-chlorinated-N-brominated isocyanurates; N-chlorinated-N-brominated melamines; N-chlorinated-N-brominated glycolurils and mixtures thereof; and (c) an organo-N-chloro compound selected from the group consisting of N-chlorinated hydantoins; N-chlorinated isocyanurates; N-chlorinates melamines; N-chlorinated glycolurils and mixtures thereof, in combination with an alkali metal or alkaline earth metal bromide salt, said alkyl containing up to 8 carbons.

As used herein, reference to the various N-brominated hydantoins; N-chlorinated-N-brominated hydantoins; N-chlorinated hydantoins and like hydantoins is intended to include the N-halo compounds of hydantoin itself or the derivatives thereof which are mono- or di-substituted at the 5 position with alkyl groups containing up to 8 carbon atoms. From an economical viewpoint the organo-N-halo-5,5-dialkylhydantoins are preferred especially those of 5,5-dimethylhydantoin. It is also noted that the various mono- and di-halo-N substituted hydantoins can be substituted at either the 1-N and/or 3-N position, and thus reference herein is made simply to the N-substituted or N,N-disubstituted materials.

Likewise, for the sake of simplicity reference herein has been made to N-brominated isocyanurates; N-chlorinated-N-brominated isocyanurates; N-chlorinated isocyanurates and the like. These terms are intended to encompass both the free acid as well as alkali metal salts thereof, containing from 1 to 3 of the specified halogen.

In accordance with a more specific embodiment of the present invention there is provided a method for the effective bleaching of textile goods at temperatures at or below about 140° F. which consists essentially in exposing the same to an aqueous solution, at said temperatures, containing an amount effective for bleaching of a material capable of generating positive bromine ions during the bleaching of said textile goods, said material being selected from the group consisting of:

(a) an organo-N-bromo compound selected from the group consisting of N-brominated-5,5-dialkylhydantoins; N-brominated isocyanurates; N-brominated melamines, N-brominated glycolurils and mixtures thereof;

(b) an organo-N-chloro-N-bromo compound selected from the group consisting of N-chlorinated-N-brominated-5,5-dialkylhydantoins; N-chlorinated-N-brominated isocyanurates; N-chlorinated-N-brominated melamines, N-chlorinated-N-brominated glycolurils and mixtures thereof; and (c) an organo-N-chloro compound selected from the group consisting of N-chlorinated-5,5-dialkylhydantoins; N-chlorinated isocyanurates, N-chlorinated melamines and N-chlorinated glycolurils, in combination with an alkali metal or alkaline earth metal bromide salt, said alkyl containing up to 8 carbons.

It is with respect to the class of N,N-Dihalo-substituted hydantoins materials in combination with a potential source of positive bromine ($Br^+$) ion, e.g., an inorganic bromide, that the present invention is in part concerned.

As will be seen, a key feature of the present invention is the generation at low temperatures of positive bromine ($Br^+$) ions which results in an unexpected degree of effective bleaching at such low temperatures. The source of the positive bromine ion may be varied as noted above depending upon cost and availability. The use of mixtures of various materials (e.g., an organo-N-chloro-compound together with a bromide salt or with an organo-N-bromo compound) is contemplated, as well as sole reagents such as N-chloro-N-bromo-5,5-dimethylhydantoin, an especially preferred material. Alternatively fully brominated organo-N compounds may be used.

It is to be understood herein, that the term "source of positive bromine ($Br^+$) ion" is intended to include not only those compounds which form the ion (e.g., organo-N-brominated compounds such as N,N-dibromo-5,5-dimethylhydantoin) under bleaching conditions, but those mixtures which under bleaching conditions will react to form compounds which generate positive bromine ions (e.g., organo-N-chloro compounds or alkali metal hypochlorites mixed with a bromide salt).

It is one embodiment of the invention to further provide a method for the effective bleaching of textile goods at temperatures below about 140° F., e.g. in the range of 60° to 140° F. and preferably about 60° to 120° F. or 80° to 120° F., which consists essentially in exposing the same to an aqueous solution, at said temperatures, containing an amount effective for bleaching of an organo-N-bromo compound selected from the group consisting of N-brominated-5,5-dialkylhydantoins; N-brominated isocyanurates; N-brominated melamines and N-brominated glycolurils. Particularly well suited are such compounds as N,N-dibromo-5,5-dialkylhydantoins (e.g., 5,5-dimethyl-N,N-dibromohydantoin and N-brominated isocyanurates).

According to yet a further specific embodiment of the present invention, there is provided an effective method for the bleaching of textile goods at low temperatures in the range of from 60° to 140° F. by exposing the textile goods to an aqueous solution at said temperatures, which solution consists essentially of a mixture by weight of:

(a) 25 to 75 parts of an organo-N-chloro compound selected from the group consisting of:

(i) N-chlorinated-5,5-dialkyl-hydantoins;

(ii) N-chlorinated isocyanurates;

(iii) N-chlorinated melamines; and (iv) N-chlorinated glycolurils; and (b) from 75 to 25 parts of an alkali metal or alkaline earth metal bromide salt. The alky group contains up to 8 carbons.

It will be recognized that greater or lesser amounts of these components may be used if desired, but the foregoing range provides a suitable variance. It is believed that in the practice of this one embodiment of the present invention, the organo-N-chlorinated compound component interacts with the bromide component to form positive positive bromine ($Br^+$) ions.

The positive positive bromine ions act as oxidizing agents for the organic, or inorganic, stain, or other discolorations to be removed from the textile. In such a process the positive bromine ions are themselves chemically reduced to the bromide ions. Such bromide ions are thus susceptible again to oxidation to new positive bromine ions, as a result of interaction with additional molecules of the organo-N-chlorinated compound. The entire process thus repeatedly occurs until the organic-N-chloro component is itself completely consumed.

Assuming the above explanation is accurate for the operation of the present invention, it was thus not known heretofore that in the complex heterogenous systems of, for instance, a conventional load of laundry, that the desired course of the reaction would occur in substantial preference to the multitude of possible competing reactions which might take place.

Thus, the amount of the weight ratio of these components may be varied considerably beyond the suggested amounts so long as a sufficient amount of positive bromine ions are formed during the bleaching operation. It will readily be appreciated by those skilled in the art, that significantly less than an equivalent amount of bromide can be used. For example, one can treat one mole of DCDMH with two moles of NaBr, thus generating in situ one mole of DBDMH. Alternatively, one can treat one mole of DCDMH with one mole of NaBr and obtain one mole of DCDMH. As shown in the examples which follow, bleaching effectiveness of DBDMH and DCDMH are equivalent. As explained above, the equivalency is due to regeneration of $Br^+$at the expense of $Cl^+$. Adding less than one mole of NaBr per one mole of DCDMH would result in a mixture of BCDMH and DCDMH, resulting in a greater reserve of $Cl^+$, providing a greater number of $Br^-$ to $Br^+$ regeneration cycles. However, reduction of NaBr to very low levels eventually would result in diminished bleaching effectiveness at low temperatures. Thus, it will be appreciated that one may utilize significantly less than an equivalent amount of bromide and still achieve a satisfactory level of effective bleaching at low temperatures.

According to one embodiment of the present invention, an improved bleaching composition is provided which, in its preferred form, consists essentially of the combination of a 5,5-di-alkylsubstituted-N,N-dichlorohydantoin component together with sodium bromide. The present invention is based in part on the unexpected discovery that such combination of the organo-N-chlorinated compound and a source of positive bromine ion, (e.g., inorganic bromide—such as chlorinated hydantoin compound with sodium bromide) leads to an unexpected degree of bleaching activity than would otherwise be expected from use of the organo-N-chlorinated compound alone.

It will be recognized by those skilled in the art, of course, that the bleaching action of N-halogenated organic compounds is thought to be due to the release of positive halogen ions which are themselves powerful oxidizing agents and act as the effective bleaching agent. It is also generally considered that positive bromine ions are effective bleaching agents. Thus, we have found that sources of positive bromine ions, including inorganic materials as well as fully brominated organo-N-bromo compounds are surprisingly effective for bleaching textile goods at temperatures below about 140° F. and especially at 120° F. or less. It has also been found according to the present invention that organo-N-brominated-N-chlorinated compounds are almost equally effective at such low temperature but are less expensive.

According to an alternative embodiment of the present invention, there is provided a method for the effective bleaching of textile goods at temperatures in the range of 60° to 140° which consists essentially in exposing the same to an aqueous solution, at said temperatures, containing an effective amount for bleaching of an organo-N-chloro-N-bromo compound selected from the group consisting of N-chlorinated-N-brominated-5,5-dialkylhydantoins; N-chlorinated-N-brominated isocyanurates; N-chlorinated-N-brominated melamines and N-chlorinated-N-brominated glycolurils, said compound being capable of generating positive bromine ($Br^+$) ions during the bleaching of said textile goods. Particularly well suited compounds include the N-chloro-N-bromo-5,5-dialkylhydantoins (e.g., 5,5-dimethyl-N,N-dibromohydantoin) and N-bromo-N-chloro-isocyanurates.

It has been observed, as in the tests described hereinafter, that N,N-dichloro-5,5-dialkylhydantoin compounds are themselves relatively ineffective as bleaching agents particularly at the lower temperatures of, for instance, 120° F. (approx. 50° C.) desired for today's bleaching operations, and not even very effective as a bleaching agent at higher temperature of, for instance, 160° F., and above (particularly at reasonable concentration levels). This is in marked contrast to the behavior of N,N-dibromo-5,5-dialkyl substituted hydantoins which are nearly as effective at 160° F. as they are at 120° F., on a weight-for-weight basis. Indeed, relatively speaking, the activity of the N,N-dichloro-5,5-dialkyl substituted hydantoins declines even more severely, with a lower temperature, than is experienced with the presently used sodium dichloroisocyanurate.

The present method and compositions used therein provide for effective and economical means for achieving effective bleaching with positive bromine ions of textile materials at temperatures significantly lower than conventionally employed heretofore.

It is also not to have been expected that at the desired lower temperatures the N,N-dichloro-5,5-dialkyl substituted hydantoins would function as effective bleaching agents, even in combination with the sodium bromide component because the lower temperatures appear to be below the required level for oxidizing effectiveness of the dichloro-5,5-dialkylhydantoin material.

As noted, a primary source of positive bromine ions for use according to the present invention is a material characterized as an organo-N-bromo compound selected from the group consisting of N-brominated-5,5-dialkylhydantoins; N-brominated isocyanurates; N-brominated melamines and N-brominated glycolurils. Such compounds may be fully or partially brominated and include such materials as 1,3-dibromo- and 1,3-bromochloro-5,5-dimethylhydantoin; 1,3-dibromo- and 1,3-bromochloro-5-methyl-5-ethylhydantoin; 1,3-diromo and 1,3-bromochloro-5,5-diisobutylhydantoin; N-monobromo-N,N-monobromo-N-monochlorocyanuric acid; N,N-dibromocyanuric acid; tribromomelamine; bromochloromelamine and the like including the alkali metal salts thereof.

In other alternative embodiments of the present invention the source of positive bromine ion may be derived in alternative ways including:

(a) an organo-N-bromo-N-chloro compound; or (b) an organo-N-chloro compound containing no N-bromo substituent in combination with a fully brominated organo-N-bromo compound or an alkali metal or alkaline earth metal bromide salt which under bleaching conditions reacts to form a compound which generates positive bromine ions.

Thus, utilizing the method of the present invention, one may employ fully brominated organo-N compounds or optionally enjoy a cost savings using organo-N-bromo-N-chloro compounds; a combination of fully brominated and fully chlorinated organo-N-halo compounds or a mixture of fully chlorinated organo-N-chloro compounds with an alkali metal or alkaline earth metal salt.

As noted above, the organo-N-chloro compound may be fully or partially chlorinated and can be selected from a number of sources. Especially preferred are the N-chlorinated-5,5-dialkylhydantoins and the N-chlorinated isocyanurates. One may also use N-chlorinated melamines or glycolurils as described in the aforementioned U.S. Pat. Nos. 3,071,591 and 3,412,021. Particularly preferred organo-N-chlorinated compounds are sodium dichloroisocyanurate (NaDCC), N,N-dichloro-5,5-dimethylhydantoin (DCDMH), N-bromo-N-chloro-5,5-dimethylhydantoin (BCDMH) potassium dichloroisocyanurate (KDCC), trichloroisocyanurate (TCC), and bromo-chloro-isocyanurate (BCCC).

Of course, the invention is not limited to the use of N,N-dichloro-5,5-dimethylhydantoin. In general, other alkyl groups may be present in place of the methyl groups, as desired, up to, for instance, lower alkyl groups of 8 carbon atoms. The N,N-dichloro hydantoin parent compound may also be used. No significant advantage is, however, seen from using alkyl groups larger than the methyl group because the resulting increased molecular weight would simply require the addition of more organic material to the system for an equivalent bleaching activity. The dimethyl-substituted hydantoin is also the presently preferred material from a standpoint of cost and availability.

A preferred source of the potential source of positive bromine ions is an inorganic bromide salt, preferably sodium bromide due to its relatively low cost and availability. However, other potential sources of the positive bromine ion besides sodium bromide may also be employed, for instance, other alkali or alkaline earth metal bromide salts (e.g., KBr, $MgBr_2$ $CaBr_2$, etc). In general, it is not a cation associated with the bromide ion that is of significance to the invention; rather, the bromide ion may be derived from any desired non-interfering source. For example, N,N-dibromo-5,5-dimethylhydantoin (DBDMH) in combination with N,N-dichloro-5,5-dimethylhydantoin (DCDMH) may be employed, the DBDMH serving as a source of positive bromine ion when the composition is placed in an aqueous environment for the bleaching of textile materials. One may also employ other organo-N-brominated materials such as N-brominated isocyanurates, melamines or glycourils. Likewise effective results are obtained utilizing an alkali metal hypohalite (e.g. sodium hypochlorite) in combination with a source of bromide (e.g. an alkali metal bromide or an organo-N-bromo-compound).

The data generally shows that equivalent bleaching is obtained with DCDMH and NaBr with substantially lesser amounts of DCDMH if potentiated with NaBr.

Since the present invention may utilize the relatively inexpensive sodium bromide salt as a substantial amount of the bleaching composition provided herein (even above 50% by weight), cost advantages can be readily realized. Moreover, since the relative amount of organic material is also reduced, effluent polluting problems can also be minimized.

The term "available halogen" as used herein, is a term established for comparing a potential bleaching or disinfecting power of halogen atoms with that of the elemental halogen on a weight basis. Elemental halogen is defined as containing 100% "available" halogen. When elemental chlorine is dissolved in water, hydrochloric acid and hypochlorous acid are generated. The hypochlorous acid is the active bleaching component. Therefore, one half of the original weight of the elemental chlorine is useless. The chlorine contained in the N-halogenated compounds is in the positive (equivalent to hypochlorous acid) state, and is therefore totally useful for bleaching. It is conventional in the industry to multiply the active ($Cl^+$) components by two and express it as available chlorine.

The amount of material capable of generating positive bromine ions should be present in the aqueous laundry bath in an amount sufficient to effectively bleach the textile goods. The amount of material used may vary significantly depending on the nature of the textile goods, water temperature, pH and the like for effective bleaching.

Customarily, in most industrial operations, one employs sufficient bleach to provide a range of from about 100 to 200 ppm of available chlorine. Less than 100 ppm (e.g. 75–80 ppm) can be used where the lower soiled condition of the textile goods permits. Higher amounts of course may be used, but care must be taken to avoid dye degradation in colored goods and tensile strength loss. Thus, in accordance with the present invention the use of a sufficient amount of material to provide positive $Br^+$ ions equivalent to 75 ppm or greater of available chlorine should be effective for bleaching. As a specific example (on a weight basis) the use of from about 150 to 300 mg of BCDMH per liter of aqueous solution provides an effective amount for bleaching at the low temperatures used according to the present invention. Likewise a concentration of from about 250 to about 300 mg of DBDMH is seen as effective.

The practice and effectiveness of the present invention is illustrated by the following tests wherein unbleached cotton muslin was washed with a control detergent, AATCC Standard 124. The machine used was a Terg-O-Tometer (60 cpm) with distilled water and a washing time of 10 minutes, followed by a 5 minutes rinse cycle and two cold water hand rinses. To measure the bleaching effectiveness, the light reflectance of the fabric was measured before and after each wash with a Photovolt reflectometer equipped with a blue filter. The results are recorded as an increase in the light reflectance of the dry samples.

The test procedure was as follows.

The standard detergent (2.5 grams/liter of water) was used with varying concentrations (per liter) of the bleaching agents, as listed hereinbelow.

In Tables 1, 2, 3 and 4 sodium dichloroisocyanurate (NaDCC) was used as a standard for comparison purposes; N,N-dichloro-5,5-dimethyldantoin (DCDMH) and N,N-dibromo-5,5-dimethylhydantoin (DBDMH) were also used for comparison purposes. A mixture of DCDMH and sodium bromide (DCDMG/NaBr) was also used, in which the weight percent of DCDMH was 48.8%. Each component was employed at three concentration levels, the same having been calculated so that at each respective level an equivalent amount of "available" halogen was present in the organic component.

The washing cycle was conducted, as indicated above, at a water temperature of 120° F. (48.9° C.), at a pH of 7 (adjusted by the use of dilute sulfuric acid and sodium carbonate). The results of the reflectance readings, measured as described above, are tabulated below.

TABLE 1

(120° F.; pH = 7)

| Ingredient | Conc. mg/liter | Increase In Reflectance Reading |
|---|---|---|
| NaDCC | 364 | 7.9 |
| NaDCC | 273 | 6.8 |
| NaDCC | 180 | 4.6 |
| DBDMH | 192 | 6.7 |
| DCDMH/NaBr | 270 | 5.2 |
| DBDMH | 144 | 4.9 |
| DCDMH | 303 | 4.7 |
| DCDMH/NaBr | 203 | 3.8 |
| DCDMH | 227 | 3.3 |
| DCDMH | 152 | 3.1 |
| DBDMH | 96 | 3.1 |
| DCDMH/NaBr | 135 | 2.5 |
| Control | | 0.73 |

The "Control" represents the results when the standard detergent alone was used.

Another test was also conducted by the same procedure described above, again with the water temperature at 120° F., but the pH of the washing solution having been adjusted to 10. Again, the results of the tests for the respective concentrations are listed below in Table 2.

TABLE 2

(120° F.; pH = 10)

| Ingredient | Conc. mg/liter | Increase In Reflectance Reading |
|---|---|---|
| NaDCC | 364 | 4.4 |
| NaDCC | 273 | 4.0 |
| DCDMH/NaBr | 270 | 3.5 |
| NaDCC | 182 | 3.1 |
| DCDMH | 303 | 3.0 |
| DBDMH | 192 | 2.9 |
| DCDMH/NaBr | 203 | 2.9 |
| DCDMH | 227 | 2.7 |
| DBDMH | 144 | 2.4 |
| DCDMH/NaBr | 135 | 2.4 |
| DCDMH | 152 | 2.2 |
| DBDMH | 96 | 2.0 |
| Control | | 0.65 |

Still another test was conducted using the procedure described again but this time with a water temperature of 160° F. (71° C.), and at a pH of 7. The results of this test for the respective concentrations of the materials employed are listed in Table 3.

TABLE 3

(160° F.; pH = 7)

| Ingredient | Conc. mg/liter | Increase In Reflectance Reading |
|---|---|---|
| NaDCC | 364 | 12.0 |
| NaDCC | 273 | 10.8 |
| NaDCC | 182 | 7.8 |
| DCDMH | 303 | 6.1 |
| DCDMH/NaBr | 270 | 6.0 |
| DBDMH | 192 | 5.7 |
| DCDMH | 227 | 5.3 |
| DCDMH/NaBr | 203 | 5.0 |

TABLE 3-continued (160° F.; pH = 7)

| Ingredient | Conc. mg/liter | Increase In Reflectance Reading |
|---|---|---|
| DCDMH | 152 | 4.7 |
| DBDMH | 144 | 4.5 |
| DCDMH/NaBr | 135 | 3.3 |
| DBDMH | 96 | 2.9 |
| Control | | 0.80 |

A fourth test was conducted, again following the above procedure, but using water adjusted to a pH of 10 and a temperature of 160° F. The reflectance reading increase results obtained are listed in Table 4.

TABLE 4

(160° F.; pH = 10)

| Ingredient | Conc. mg/liter | Increase In Reflectance Reading |
|---|---|---|
| NaDCC | 364 | 4.7 |
| NaDCC | 273 | 4.1 |
| NaDCC | 182 | 3.2 |
| DCDMH | 303 | 3.2 |
| DBDMH | 192 | 2.5 |
| DCDMH/NaBr | 270 | 2.5 |
| DCDMH | 227 | 2.4 |
| DCDMH/NaBr | 203 | 2.4 |
| DCDMH/NaBr | 135 | 2.1 |
| DCDMH | 152 | 1.8 |
| DBDMH | 144 | 1.7 |
| DBDMH | 96 | 1.4 |
| Control | | 0.85 |

From these data it will be seen that the dichloro hydantoin/sodium bromide combination exhibits a far greater relative bleaching effectiveness than the dichloro hydantoin used alone. To interpret these data it should also be appreciated that each of the respective concentrations of the DCDMH used alone and of the NaDCC provides an equivalent "available" chlorine concentration. That is, e.g., 227 mg of the DCDMH provides the same number of chlorine atoms as 273 mg of the NaDCC (calculated as the dihydrate). This is also true for the DCDMH concentrations, used in the admixture with NaBr, with respect to the amounts of DBDMH employed (e.g., the three DCDMH concentrations thus used, 66 mg, 99 mg, 132 mg, respectively provide the same number of halogen atoms as do 96, 144 and 192 mg of DBDMH).

To further illustrate the advantage of the invention, these data for a pH of 7 are graphically portrayed in the attached FIG. 1 wherein the solid curves connect data points measured at 120° F. and the dashed curves connect data points at 160° F. in the above tests. The data is plotted on the basis of the concentration of the organic bleaching agent present.

It is readily seen therefrom that used by itself DCDMH (the triangular points) is, comparatively speaking, a rather ineffective bleach used at 120° C. However, when used in combination with sodium bromide, it is even more effective than the dibromo dimethyl hydantoin, on a weight-for-weight basis. For instance, to obtain a reflectance reading increase of 5, a concentration of approximately 115 mg per liter of DCDMH, in combination with sodium bromide, is sufficient, whereas for the same increase in reflectance reading a concentration approximately 145 mg of DBDMH is necessary, i.e., 26 weight percent more. As noted above, even when these relative amounts are considered on an equivalent "available" halogen basis, the bleaching effectiveness of the DCDMH is some 80% of that of the DBDMH, when the former is used in combination with sodium bromide. In absence of sodium bromide, at 120° F. and a pH of 7, the DCDMH is only about 30% as effective as DBDMH, on the same basis.

For the data at pH of 10 in the above Tables, it can also be seen that the combination with NaBr greatly increases the bleaching effect of DCDMH, however, the bleaching effectiveness of all materials is depressed under these alkaline conditions.

Yet another test was conducted by the same procedure described above, but at several different temperatures, 160°, 110° and 60° F. at a pH of 10. In each instance the amount of ingredient was adjusted to give 200 ppm total halogen expressed as chlorine. In addition to the materials tested above, comparisons were made with sodium hypochlorite (NaOCl) and N-bromo-N-chloro-5,5-dimethylhydantoin (BCDMH). The results are set forth in Table 5.

TABLE 5

| Ingredient | Increase in Reflectance Reading at 160° F. | 110° F. | 60° F. |
|---|---|---|---|
| NaOCl | 41.1 | 23.7 | 7.9 |
| NaDCC | 42.1 | 28.9 | 10.6 |
| DCDMH | 20.2 | 23.2 | 18.6 |
| BCDMH | 41.6 | 36.3 | 28.7 |
| DBDMH | 43.5 | 38.3 | 30.9 |

A further procedure was carried out as reported in Table 5, but in this instance, where there was chlorine present in the ingredient, an equivalent amount of NaBr was added (i.e. Br=Cl), to give a total available chlorine at 200 ppm. The results are set forth in Table 6.

TABLE 6

| Ingredient | Increase in Reflectance Reading at 160° F. | 110° F. | 60° F. |
|---|---|---|---|
| DCDMH/NaBr | 43.6 | 39.1 | 32.6 |
| NaOCl/NaBr | 48.2 | 41.5 | 31.7 |
| NaDCC/NaBr | 48.4 | 41.3 | 34.4 |

The use of material herein which generate positive bromine ions under bleaching conditions at temperatures below 140° and especially 120° F. avoids harsh and detrimental treatment of the textile material. Thus, a bleach composition formed from a mixture of sodium hypochlorite and sodium bromide is effective at lower concentrations than used heretofor for NaOCl at high temperatures.

A number of additional tests were performed to demonstrate the unexpected degree of effectiveness BCDMH both at high and low temperatures.

Test Procedures

Bleaching tests were performed using Empa 115 Bleach Test Cloth, Cotton Print, Style 400 obtained from Testfabrics, Inc. Each test utilized three 4"×4" specimens of the Empa cloth and nine 4"×4" specimens of unsoiled 100% cotton and was duplicated.

A hunger Model D-40 was used to measure fabric reflectance. The difference between fabric reflectance before and after bleaching, i.e., reflectance increase, was measured. A green filter was used to exclude fluorescence. Two measurements at right angles were made on the specimens before and during washing. Hard water was used in the washing tests. It was prepared by adding enough $CaCl_2.2H_2O$ and $MgCl_2.6H_2O$ to give 150 ppm hardness as $CaCO_3$ with a Ca/Mg ratio of 3:1.

To 1-liter of hard water was added 1500 mg of TIDE (6.1% P), which was stirred for one minute. The pH was adjusted with 20% sodium hydroxide (to pH 11) or with 2N $H_2SO_4$ (to pH 7). The bleach was then added, stirred for an additional minute, and the pH readjusted to the desired value. The soiled specimens were added, one by one, followed by the unsoiled cotton.

The specimens were washed for ten minutes at 100 r.p.m. The swatches were squeezed by hand, and rinsed twice for two minutes in the Terg-O-Tometer with the hard water; squeezed dry by hand, and dried at 120° F. in a forced air oven. Bleaching Effectiveness at pH 11

The bleaching effectiveness of BCDMH was compared with sodium hypochlorite and sodium dichloroisocyanurate (NaDCC) at pH 11. BCDMH and NaDCC were compared at concentrations of 150,300 and 600 mg per liter. The concentrations of sodium hypochlorite (5.25% NaOCl) used were 1665, 3330 and 6660 mg per liter, or concentrations of available chlorine equivalent to those contributed by 150, 300 and 600 mg/l of NaDCC.

The relative concentrations are set forth in Table 7.

TABLE 7

| SODIUM HYPOCHLORITE | | |
|---|---|---|
| Concentration, mg/liter | Available Chlorine, % | Concentration of Available Chlorine, ppm |
| 1665 | 5.0 | 83 |
| 3330 | 5.0 | 166 |
| 6660 | 5.0 | 332 |
| NaDCC | | |
| 150 | 55.3 | 83 |
| 300 | 55.3 | 166 |
| 600 | 55.3 | 332 |

| BCDMH | | | | |
|---|---|---|---|---|
| Conc., mg/liter | % Cl | % Br | % Available Chlorine (equiv.) | Conc. of Available Chlorine Equiv. (ppm) |
| 150 | 16.4 | 30.2 | 59.8 | 90 |
| 300 | 16.4 | 30.2 | 59.8 | 180 |
| 600 | 16.4 | 30.2 | 59.8 | 360 |

Figure 2:
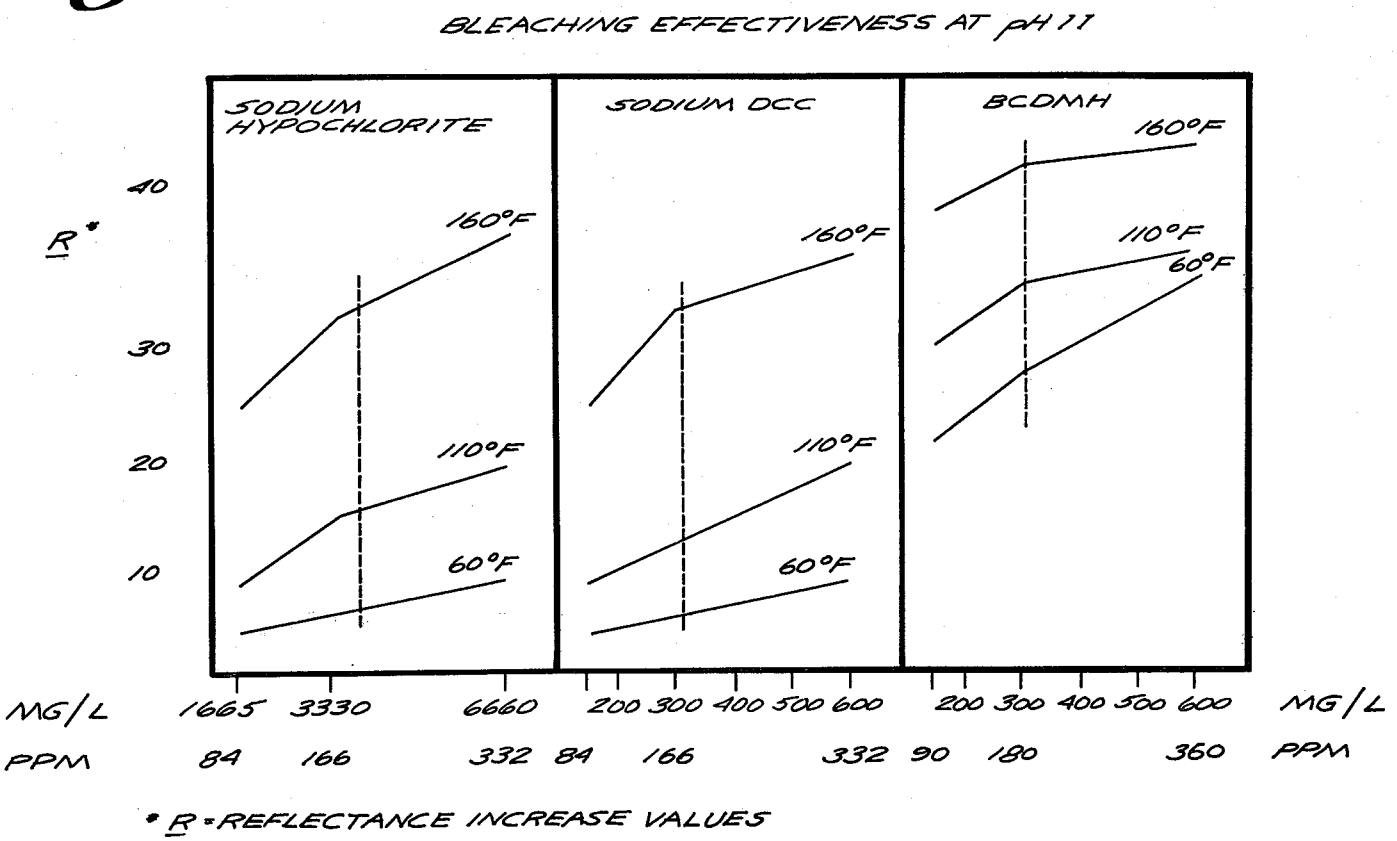

The reflectance values in FIG. 2 show BCDMH is a remarkably more effective bkleach than either NaDCC or sodium hypochlorite at a temperature of 60° F. over a concentration range of 150 to 600 mg/liter. The increased effectiveness is observable throughout the temperature range of 60° F. to 160° F.

In Table 8, the reflectance ratios of sodium hypochlorite, NaDCC, and BCDMH are shown at three temperature levels, based on interpolation of data in FIG. 2. At a concentration level of 200 mg/l, BCDMH is 6.17 times more effective at 60° F., 2.4 times at 100° F. and 1.62 times at 160° F. than hypochlorite and NaDCC. It is interesting to note that at equivalent available chlorine concentrations, NaDCC is equivalent to hypochlorite in bleaching effectivess.

TABLE 8

| | Reflectance Ratios | | |
|---|---|---|---|
| Mg/liter | NaOCl* | NaDCC | BCDMH |
| | 60° F. | | |
| 200 | 1.0 | 1.00 | 6.17 |
| 300 | 1.0 | 0.98 | 5.54 |
| 400 | 1.0 | 1.00 | 5.00 |
| 500 | 1.0 | 0.99 | 4.59 |
| 600 | 1.0 | 1.01 | 4.44 |

TABLE 8-continued

| | Reflectance Ratios | | |
|---|---|---|---|
| Mg/liter | NaOCl* | NaDCC | BCDMH |
| | 100° F. | | |
| 200 | 1.0 | 0.91 | 2.40 |
| 300 | 1.0 | 0.87 | 2.05 |
| 400 | 1.0 | 0.93 | 2.00 |
| 500 | 1.0 | 0.94 | 1.94 |
| 600 | 1.0 | 0.95 | 1.79 |
| | 160° F. | | |
| 200 | 1.0 | 1.00 | 1.62 |
| 300 | 1.0 | 1.04 | 1.46 |
| 400 | 1.0 | 1.04 | 1.40 |
| 500 | 1.0 | 0.97 | 1.28 |
| 600 | 1.0 | 0.95 | 1.21 |

*Equivalent to the available chlorine in the levels of NaDCC shown.

Figure 3:
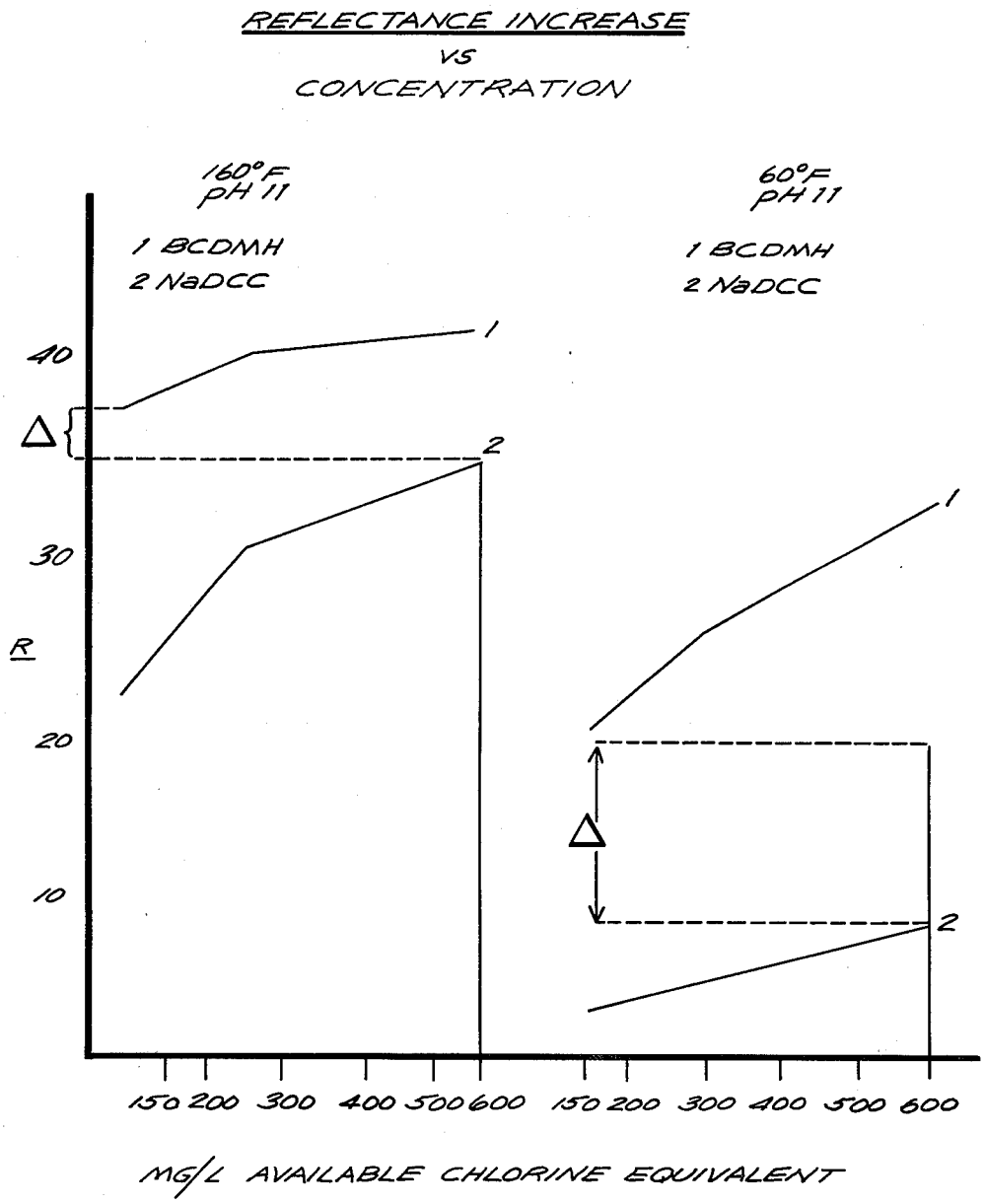

The data in FIG. 3 reveals that at 160° F., BCDMH at a concentration of 150 mg/l is more effective than 600 mg/l of NaDCC. At 60° F., BCDMH at 150 mg/l is 2.4 times more effective than NaDCC at 600 mg/l. The performance ratio at 60° F. becomes even more favorable at higher BCDMH concentrations. Therefore, lower cost bleaching can be achieved at either high or low temperatures.

As is evident, BCDMH provides a unique bleach which is highly efficient at both high and low temperatures, offering therefore a significant potential means of conserving energy.

Thus, experimentation reveals that both dichloro and dibromodimethylhydantoin readily give up one equivalent of positive halogen.

Monobromo- and monochlorodimethylhydantoin (MBDMH and MCDMH) are relatively stable compounds that resist hydrolysis. However, MBDMH will hydrolyze more readily than MCDMH. This conclusion is supported by the reflectance increase values in FIG. 4. Comparing MBDMH with MCDMH, one observes that at higher temperatures, the R values for MBDMH are significantly higher than those of MCDMH.

Figure 4:
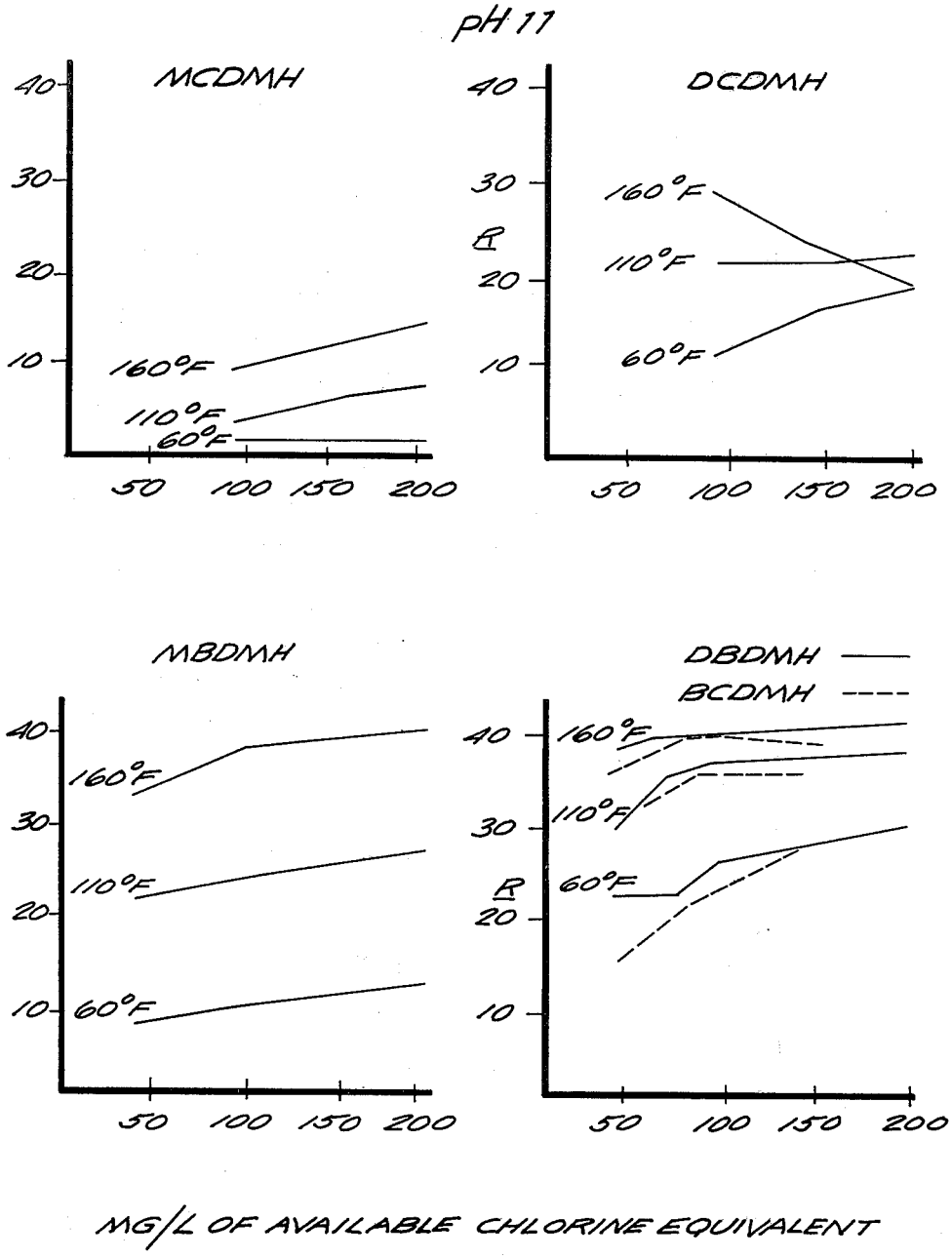

It is obvious that MBDMH hydrolyzes at higher temperatures, while the MCDMH hydrolyzes to a lesser degree. The R values also show that at 160° F. the bleaching properties of MBDMH are equivalent to those of dibromodimethylhydantoin (at equivalent bromine concentration) further supporting the conclusion that MBDMH is hydrolyzed to the same extent at 160° F. The dotted lines in FIG. 4 show the R values for BCDMH which contains both chlorine and bromine. The combined halogens lower the activation temperature, compared with the MBDMH and MCDMH above. At 100 and 150 ppm of available chlorine equivalent the bleaching properties of DBDMH and BCDMH are equivalent.

Anomalous results are obtained with DCDMH. R values were observed to decrease at high concentrations of available chlorine (FIG. 4, DCDMH). This phenomenon is not understood.

The unique behavior of the BCDMH is believed due to the greater bleaching properties of bromine as well as the regeneration of active bromine at the expense of active chlorine. The conversions repeat until there is complete utilization of all active bromine and chlorine.

In Terg-O-Tometer tests using Empa Cloth, BCDMH is six times more effective than sodium hypochlorite and sodium dichloroisocyanurate at 60° F., and at 160° F., BCDMH is more than four times as effective as these two bleaching agents under the high pH conditions used in industrial and institutional laundries. Under milder conditions at pH 7, BCDMH is twice as effective as sodium dichloroisocyanurate.

The outstanding bleaching power of BCDMH at both high and low temperatures is due to its low temperature of activation, the greater bleaching properties of bromine, and a completed and controlled release of the active chlorine and bromine.

Further, the invention is not limited to the use of approximately 50:50 weight mixtures of the organo-N-chloro or alkali metal hypochlorite and bromide components in the composition. Considering, for example, the N,N-dichloro dimethylhydantoin and sodium bromide combination, weight ratios in the range of at least 25:75 up to 75:25, preferably 40:60 up to 60:40 may be employed. Similar proportions may also be used, calculated on a basis of available chlorine on the one hand and bromide ion on the other hand when other organo-N-chloro compounds and bromide salts are employed. Again where cost considerations permit, the use of solely an organo-N-brominated compound is very effective at low temperatures.

As a result, one is able to achieve effective bleaching at low temperatures with a corresponding decrease in the amount of effluent and cost due to the enhanced bleaching effect attributable to the compositions employed according to the present invention.

Furthermore, significantly less organic material will then be present in the effluent from a laundry or bleaching system when using the composition of the present invention as compared to the amount which would be introduced if NaDCC were used at an equivalent level of bleaching effectiveness.

A further series of tests were conducted to illustrate the effectiveness of N-bromo-N-chloro compounds for bleaching at low temperatures. In each test, 0.82 gm of grey Empa cloth (10 cm×9 cm) was placed in a flask together with 500 ml of distilled water and 750 mg of detergent (Tide). Several potential bleach compounds were added as ingredients in separate runs in an amount to provide 150 ppm of equivalent chlorine and the pH adjusted to 11. The flask was then agitated for 13.5 minutes in a thermostatically controlled shaker bath maintained at 60° F. (about 100 oscillations/minute). The cloth was then rinsed twice in 500 ml of distilled water, removed, air dried at room temperature and visibly observed for bleaching effectiveness with the results being noted in Table 9 below.

TABLE 9

| Ingredient | Observation at 60° F. |
|---|---|
| None (detergent only at pH 11) | Cloth grey |
| NaDCC | Cloth grey - no change |
| NaOCl | Cloth grey - no change |
| BCDMH | Noticeably whitened |
| BCCC | Noticeably whitened |

A number of conclusions can be obtained from the above, but the most notable is the activation of organo-chloro compounds by addition of bromide.

An additional series of tests were conducted as above to demonstrate the effectiveness of the present invention at 60° F. using varying equivalents of (a) NaOCl and NaBr; DCDMH and DBDMH and DBDMH.

In each test, 0.82 gm of grey Empa cloth (10 cm×9 cm) was placed in a flask together with 500 ml of distilled water and 750 mg of detergent (Tide). The bleach compounds were added as ingredients in separate runs in the amounts noted and the pH adjusted to 11. The flask was then agitated for 10 minutes in a thermostatically controlled shaker bath maintained at 60° F. (about 100 oscillations/minute). The cloth was then rinsed twice in 500 ml of distilled water, removed, air dried at room temperature and visibly observed for bleaching effectiveness with the results being noted in Table 10 below in the order of decreasing effectiveness.

TABLE 10

| | Ingredient | Equivalent Ratio | Observation at 60° F. |
|---|---|---|---|
| (1) | NaOCl (1500 mg) NaBr (104 mg) | 1:1 | Very effective bleaching |
| (2) | DCDMH (52 mg) DBDMH (76 mg) | 1:1 | Very effective bleaching |
| (3) | DBDMH (151 mg) | | Very effective bleaching |
| (4) | NaOCl (1500 mg) NaBr (52 mg) | 1:0.5 | Good bleaching |
| (5) | DCDMH (79 mg) DBDMH (38 mg) | 1:0.33 | Good bleaching |
| (6) | NaOCl (1500 mg) | 1:0.1 | Bleaching observed |
| (7) | DCDMH (94 mg) NaBr (915 mg) | 1:0.1 | Bleaching observed |
| (8) | NaOCl (1500 mg) | — | No bleaching |
| (9) | DCDMH (105 mg) | — | No bleaching |

While the foregoing examples illustrate the particular advantages of the invention at washing temperatures of about 120° F., it will also be appreciated that similar effects will be realized at other temperatures, ranging from about 60° F. up to about 140° F., the precise level thereof depending upon the particular composition and conditions employed. Of course, the technological effectiveness of the invention is also demonstrated at even higher temperatures, such as at 160° F., although from a cost-effective standpoint the present compositions are not, at present, competitive with other existing bleaching systems.

What is claimed is:

1. A method for the effective bleaching of textile goods at temperatures at or below about 140° F. which consists essentially in exposing same to an aqueous solution, at said temperatures, containing an amount effective for bleaching of a material capable of generating positive bromine ions (Br+) during the bleaching of said textile goods.

2. The method of claim 1, wherein the temperature is 120° F. or less.

3. The method of claim 1 wherein the temperature ranges from about 60° to 120° F.

4. The method according to claim 1, wherein the temperature ranges from about 80° to 120° F.

5. The method of claim 1, 2 or 3 wherein said material is a alkali metal hypobromite or alkali metal hypochlorite combined with an alkali metal bromide.

6. The method of claims 1, 2, 3 or 4 wherein said material is selected from the group consisting of:

(a) an organo-N-bromo compound selected from the group consisting of N-brominated-hydantoins; N-brominated isocyanurates; N-brominated melamines; N-brominated glycolurils and mixtures thereof:

(b) an organo-N-chlor-N-bromo compound selected from the group consisting of N-chlorinated-N-brominated-hydantoins; N-chlorinated-N-brominated isocyanurates; N-chlorinated-N-brominated melamines; N-chlorinated-N-brominated glycolurils and mixtures thereof; and (c) an organo-N-chloro compound selected from the group consisting of N-chlorinated-hydantoins; N-chlorinated isocyanurates, N-chlorinated melamines, N-chlorinated glycolurils and mixtures thereof, in combination with an alkali metal or alkaline earth metal bromide salt.

7. A method for the effective bleaching of textile goods at temperatures at or below about 140° F. which consists essentially in exposing same to an aqueous solution, at said temperatures, containing an amount effective for bleaching of a material capable of generating positive bromine ions (Br+) during the bleaching of said textile goods, said material being selected from the group consisting of:

(a) an organo-N-bromo compound selected from the group consisting of N-brominated-5,5-dialkylhydantoins; N-brominated isocyanurates; N-brominated melamines; N-brominated glycolurils and mixtures thereof;

(b) an organo-N-chloro-N-bromo compound selected from the group consisting of N-chlorinated-N-brominated-5,5-dialkylhydantoins; N-chlorinated-N-brominated isocyanurates; N-chlorinated-N-brominated melamines; N-chlorinated-N-brominated glycolurils and mixtures thereof; and (c) an organo-N-chloro compound selected from the group consisting of N-chlorinated-5,5-dialkylhydantoins; N-chlorinated isocyanurates, N-chlorinated melamines, N-chlorinated glycolurils and mixtures thereof, in combination with an alkali metal or alkaline earth metal bromide salt, said alkyl containing up to 8 carbons.

8. The method of claim 7, wherein the temperature is 120° F. or less.

9. The method of claim 7 wherein the temperature ranges from about 60° to 120° F.

10. The method according to claim 7, wherein the temperature ranges from about 80° to 120° F.

11. The method of claim 7, 8 or 9 wherein said material is a N-chloro-N-bromo-5,5-dialkylhydantoin.

12. The method of claim 11 wherein said material is N-chloro-N-bromo-5,5-dimethylhydantoin.

13. The method of claim 12 wherein the concentration of material in the aqueous solution ranges from about 150 to about 300 mg/l.

14. A method for the effective bleaching of textile goods at temperatures in the range of 60° to 140° F. according to claim 7 which consists essentially in exposing the same to an aqueous solution, at said temperatures, containing an amount effective for bleaching of an organo-N-bromo compound selected from the group consisting of N-brominated-5,5-dialkylhydantoins; N-brominated isocyanurates; N-brominated melamines, N-brominated glycolurils and mixtures thereof.

15. The method of claim 14 wherein said compound is selected from 1,3-dibromo-5,5-dialkylhydantoins, N-brominated isocyanurates and mixtures thereof.

16. The method of claim 14 wherein said material is a N-brominated-5,5-dialkylhydantoin material selected from the group consisting of:

N,N-dibromo-5,5-dimethylhydantoin;
N,N-dibromo-5-ethyl-5-methylhydantoin;
N,N-dibromo-5,5-diethylhydantoin;
N,N-dibromo-5,5-diisobutylhydantoin;
N,N-dibromo-5-methyl-5-n-amylhydantoin;
N,N-dibromo-5-methyl-5-hexylhydantoin;
N-bromo-5,5-dimethylhydantoin;
N-bromo-5-ethyl-5-methylhydantoin;
N-bromo-5,5-diethylhydantoin;
N-bromo-5,5-diisobutylhydantoin;
N-bromo-5-methyl-5-n-amylhydantoin
N-bromo-5-methyl-5-hexylhydantoin and mixtures thereof.

17. The method of claim 14 wherein said material is 1,3-dibromo-5,5-dimethylhydantoin which is present in the aqueous solution at a concentration ranging from about 250 to about 300 mg/l.

18. The method of claim 14 wherein said material is N-brominated isocyanurates selected from the group consisting of:

tribromocyanuric acid;
dibromocyanuric acid;
monobromocyanuric acid;
the alkali metal salts thereof and mixtures thereof.

19. The method of claim 14 wherein said material is N-brominated melamines selected from the group consisting of:

tribromomelamine;
dibromomelamine;
monobromomelamine and mixtures thereof.

20. A method for the effective bleaching of textile goods at temperatures in the range of 60° to 140° according to claim 7 which consists essentially in exposing the same to an aqueous solution, at said temperatures, containing an effective amount for bleaching of an organo-N-chloro-N-bromo compound selected from the group consisting of N-chloro-N-bromo-5,5-dialkylhydantoins; N-chlorinated-N-brominated isocyanurates; N-chlorinated-N-brominated melamines, N-chlorinated-N-brominated glycolurils and mixtures thereof.

21. The method of claim 8 wherein said organo-N-chloro-N-bromo compound is selected from the group consisting of a N-bromo-N-chloro-5,5-dialkylhydantoin and N-bromo-N-chloro isocyanurates.

22. The method of claim 21 wherein said compound is selected from the group consisting of:

N-chloro-N-bromo-5,5-dimethylhydantoin;
N-chloro-N-bromo-5-ethyl-5-methylhydantoin;
N-chloro-N-bromo-5,5-diethylhydantoin;
N-chloro-N-bromo-5,5-diisobutylhydantoin;
N-chloro-N-bromo-5-methyl-5-n-amylhydantoin;
N-chloro-N-bromo-5-methyl-5-hexylhydantoin.

23. The method of claim 21 wherein said compound is selected from the group consisting of:

N-monobromo-N,N-dichlorocyanuric acid;
N-monobromo-N-monochlorocyanuric acid;
sodium-N-monobromo-N-monochlorocyanurate;
potassium-N-monobromo-N-monochlorocyanurate and mixtures thereof.

24. A method for the effective bleaching of textile goods at temperatures in the range of 60° to 140° F. according to claim 7 which consists essentially in exposing the same to an aqueous solution, at said temperatures, containing a mixture consisting essentially of an organo-N-chloro compound selected from the group consisting of N-chlorinated-5,5-dialkylhydantoins; N-chlorinated isocyanurates, N-chlorinated melamines, N-chlorinated glycolurils, and mixtures thereof, in combination with an alkali metal or alkaline earth metal bromide salt, said alkyl containing up to 8 carbons.

25. The method of claim 24, where said organo-N-chloro compound is present in an amount of 25 to 75 parts by weight and said bromide salt is present in an amount ranging from 75 to 25 parts by weight.

26. The method of claim 24, wherein said salt is an alkali metal bromide.

27. The method according to claim 24 or 25, wherein said organo-N-chloro compound is present in an amount from 40 to 60 parts by weight and wherein said salt is present in said solution in an amount of from 60 to 40 parts by weight.

28. The method of claim 24, wherein said temperature is in the range of 80° to 120° F.

29. The method of claim 24 or 25 wherein said organo-N-chloro compound is 1,3-dichloro-5,5-dimethylhydantoin.

30. The method of claim 24 or 25, wherein said organo-N-chloro compound is sodium dichloroisocyanurate, potassium dichloroisocyanurate, trichloroisocyanuric acid or mixtures thereof.

31. A method for the effective bleaching of textile goods at temperatures in the range of 100° to 140° F. which consists essentially in exposing the same to an aqueous solution, at said temperatures, containing mixture consisting essentially of 25 to 75 parts by weight of N,N-dichloro-5,5-dialkylhydantoin and from 75 to 25 parts by weight of an alkali metal or alkaline earth metal bromide salt, said alkyl containing up to 8 carbons.

32. The method of claim 31, wherein said salt is an alkali metal bromide.

33. The method of claim 31, wherein said hydantoin is present in an amount of from 40 to 60 parts by weight and wherein said salt is present in an amount of from 60 to 40 parts by weight.

34. The method of claim 31, wherein said bromide salt is sodium bromide.

35. The method of claim 32, wherein said hydantoin is N,N-dichloro-5,5-dimethylhydantoin.

36. The method of claim 35, wherein said bromide salt is selected from the group consisting of KBr, $MgBr_2$ and $CaBr_2$.

37. A method for the effective bleaching of textile goods at temperatures in the range of 60° to 140° F. which consists essentially in exposing the same to an aqueous solution, at said temperatures, containing an amount effective for bleaching at said temperatures of a mixture consisting essentially of an organo-N-chloro compound selected from the group consisting of N-chlorinated-hydantoins; N-chlorinated isocyanurates, N-chlorinated melamines, N-chlorinated glycolurils, and mixtures thereof in combination with a material capable of generating positive bromine ions (Br+) during the bleaching of said textile goods.

38. The method of claim 37 wherein said mixture consists essentially of 1,3-dichloro-5,5-dimethylhydantoin and 1,3-dibromo-5,5-dimethylhydantoin.

39. The method of claim 37 wherein the material capable of generating positive bromine ions is selected from the group consisting of N-brominated-5,5-dialkylhydantoins; N-brominated isocyanurates; N-brominated melamines, N-brominated glycolurils and mixtures thereof.

40. The method of claim 37, 38 or 39 wherein said mixture consists essentially of 25 to 75 parts by weight of said organo-N-chloro compound and from 75 to 25 parts by weight of said material capable of generating positive bromine ions.

* * * * *